US005078544A

United States Patent [19]

Harzer et al.

[11] Patent Number: 5,078,544

[45] Date of Patent: Jan. 7, 1992

[54] ARRANGEMENT FOR THE CHANGEOVER OF LIQUIDS WHEN TRANSPORTED BY MEANS OF A THREE CHAMBER TUBE FEEDER

[75] Inventors: Johann Harzer, Essen; Pal Meszaros, Dortmund; Ottmar Christian, Netphen, all of Fed. Rep. of Germany

[73] Assignee: Siemag Transplan GmbH, Fed. Rep. of Germany

[21] Appl. No.: 565,349

[22] Filed: Aug. 10, 1990

[30] Foreign Application Priority Data

Aug. 10, 1989 [DE] Fed. Rep. of Germany ..... 3926464

[51] Int. Cl.[5] ..... E02D 19/14

[52] U.S. Cl. ..... 405/130; 62/260; 165/45; 165/104.31

[58] Field of Search ..... 405/56, 130, 52; 62/260; 165/104.31, 45; 299/16

[56] References Cited

U.S. PATENT DOCUMENTS

| | | | |
|---|---|---|---|
| 3,220,470 | 11/1965 | Balch | 405/130 X |
| 3,950,958 | 4/1976 | Loofbourow | 405/56 X |
| 4,750,333 | 6/1988 | Husain et al. | 62/260 X |
| 4,991,998 | 2/1991 | Kamino et al. | 405/130 |

FOREIGN PATENT DOCUMENTS

| | | |
|---|---|---|
| 1181250 | 1/1985 | Canada . |
| 2457943 | 6/1976 | Fed. Rep. of Germany . |
| 3108936 | 9/1982 | Fed. Rep. of Germany . |
| 3040283 | 9/1985 | Fed. Rep. of Germany . |

*Primary Examiner*—Randolph A. Reese
*Assistant Examiner*—John A. Ricci
*Attorney, Agent, or Firm*—Toren, McGeady & Associates

[57] ABSTRACT

An arrangement for the changeover of mine or warm water and fresh or cold water in underground mining by a three chamber tube feeder with constant filling and discharge direction, which feeder is arranged between a high pressure liquid cycle, which forms on the one hand, an aboveground feeding-in of the fresh or cold water and, on the other hand, a transportation of the mining or warm water, and an underground low pressure liquid cycle, which three chamber tube feeder ensures a direct and continuous changeover, and which feeder is provided with blocking members at the end of the chambers, wherein automatic non-return valves are provided as the blocking members exclusively at a low pressure filling side allocated to the mining or warm water, and at a high pressure discharge side, allocated to the mining or warm water, of each chamber of the three chamber tube feeder, a separate externally controlled high pressure side valve being provided as the blocking member at a high pressure fresh or cold water inlet side, and at a low pressure fresh or cold water discharge side, of each chamber of the feeder.

2 Claims, 2 Drawing Sheets

ARRANGEMENT FOR THE CHANGEOVER OF LIQUIDS WHEN TRANSPORTED BY MEANS OF A THREE CHAMBER TUBE FEEDER

FIELD OF INVENTION

The present invention relates to an arrangement for the changeover of liquids when transported by means of a three chamber tube feeder.

More particularly, the invention relates to an arrangement for the changeover of mine (or pit) or warm water and fresh or cold water in underground mining by means of a three chamber tube feeder with constant filling and discharge direction, which feeder is arranged between the high pressure liquid cycle, which, on the one hand, constitutes the aboveground feeding-in of the fresh or cold water and, on the other hand, the transportation of the mining or warm water, and the underground low pressure liquid cycle, which three chamber tube feeder ensures a direct and continuous changeover, and which feeder is provided with blocking members at the ends of the chambers.

BACKGROUND TO INVENTION

An arrangement of this type is known from the DE-PS 24 57 943. Herewith, by using a three chamber tube feeder, a hydraulic transportation over great differences in height is performed, in that the blocking members, which are arranged at the ends of the chambers, allow a continuous filling and transportation when suitably connected together.

The continuous hydraulic transportation across great heights, according to the mentioned principle, is also made possible according to the DE-PS 30 40 283, which changes, by means of the three chamber tube feeder, the cold water required in underground mining over with the warm water resulting in the underground region. Thereby the advantageous result is obtained to transport slurry and liquids, containing solid materials, without problems by means of the three chamber tube feeder.

The changeover of mining and fresh water and/or of warm and cold water by means of the three chamber tube feeder transportation method achieves exceedingly high operational cost savings because such a transportation of the mining water out of the mine requires low additional energy costs as compared to the conventional transportation methods utilizing adequate pumps.

However, on filling or discharging the chambers, it has been found disadvantageous that strong water hammer and pressure surges occur in the tube chamber system because the switching over from high to low pressure, or vice versa, takes place by means of blocking members provided as controlled high pressure slide valves. However, these water hammers or pressure surges in many cases can permanently detrimentally influence the satisfactory operation of the total plant.

It therefore is an object of the invention to provide an arrangement of the type mentioned for changeover of mining or warm water and fresh or cold water by means of simple means, such that the creation of water hammer and pressure surges in the reversal of high to low pressure, as well as vice versa, can be countered to a great extent.

SUMMARY OF INVENTION

According to the invention, an arrangement for the changeover of mine (or pit) or warm water and fresh or cold water in underground mining by means of a three chamber tube feeder with constant filling and discharge direction, which feeder is arranged between the high pressure liquid cycle, which, on the one hand constitutes the aboveground feeding-in of the fresh or cold water and, on the other hand, the transportation of the mining or warm water and the underground low pressure liquid cycle, which three chamber tube feeder ensures a direct and continuous changeover, and which feeder is provided with blocking members at the ends of the chambers, is characterized thereby that non-return valves are provided as blocking members both at the low pressure filling side, allocated to the mining or warm water, as well as at the high pressure discharge side, allocated to the mining or warm water, of each chamber of the three-chamber tube feeder.

It has been found that by means of the arrangement in accordance with the invention the water hammer and pressure surges can be greatly dampened.

In a preferred design of the arrangement in accordance with the invention nozzle non-return valves are used as non-return valves. Thereby it has been found that such nozzle non-return valves with short closing paths close more rapidly and reliably than is the case with other types of non-return valves of comparative construction.

When the pressure and flow velocity drops below the measurement of the adjusted spring force, the valve disc already moves completely without impact onto the seat ring because the nozzle non-return valve is closed timeously by means of the spring force and not by means of the flowing medium. The nozzle non-return valves for this reason achieve an extraordinary long life. It is also advantageous that the pressure loss in these nozzle non-return valves is particularly low.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
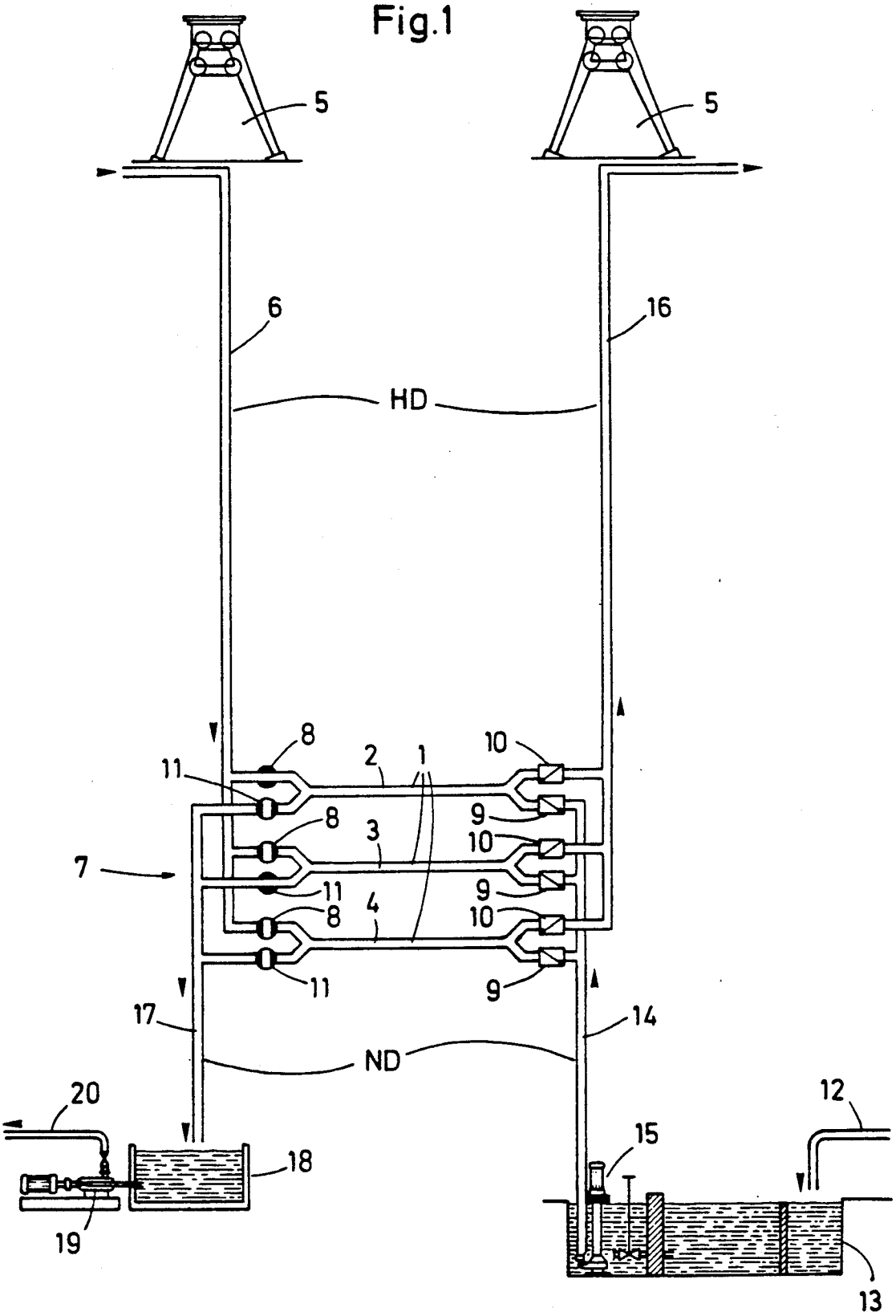
FIG. 1 a schematic representation of a three chamber tube feeder with associated high pressure and low pressure liquid cycle.

In FIG. 1 a three chamber tube feeder 1 with its three chambers 2, 3 and 4 is shown in schematic representation.

It is arranged and designed such that it can couple a high pressure cycle HP and a low pressure cycle LP for direct and continuous changeover so as to transport, on the one hand, fresh water or cold water from the aboveground region into the underground region, and, on the other hand, mining water or warm water from the underground region into the aboveground region.

Fresh water or cold water is fed from the aboveground region 5 by means of the high pressure conduit 6 into the underground region 7 and is fed to the chambers 2, 3, 4, of the three-chamber tube feeder 1.

The pressure built up and also the pressure reduction in the chambers 2, 3 and 4 of the three chamber tube feeder 1 is performed by means of blocking members 8 to 11, which are associated with each chamber 2, 3 and 4, and which partially cooperate with switches and devices—which are not illustrated—serving for their control.

High pressure valves in the form of separately operated double disc valves as blocking members 8 are provided at each chamber 2, 3, 4 of the three chamber tube feeder 1 both at the high pressure filling side allocated to the fresh water or cold water as well as to the low pressure discharge side allocated to the fresh water or cold water.

Figure 2:
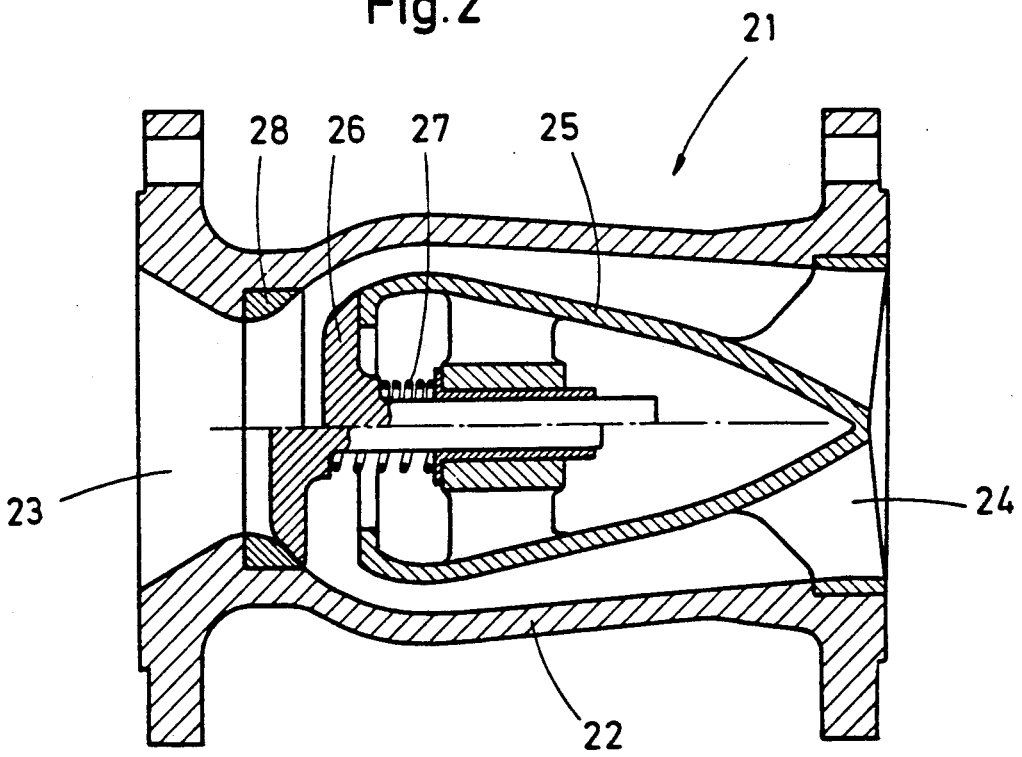
FIG. 2 a detail of the three chamber tube feeder according to FIG. 1 in accordance with the invention.

These high pressure double disc valves thereby are controlled by the switches and devices just mentioned—but not illustrated. Non-return valves are provided as blocking members 9 and 10 both at the low pressure filling side allocated to the mining water or warm water as well as to the high pressure discharge side allocated to the mining water or warm water of each chamber 2, 3 and 4 of the three chamber tube feeder 1, each of which valves preferably is designed as a nozzle non-return valve, as is also shown in FIG. 2 of the drawings.

The mining water or warm water arriving via the mining water supply 12 into the sump or pre-clarification basin 13 is supplied in counter-current to the fresh water or cold water via the low pressure mining water conduit 14 to the chambers 2, 3 and 4 of the three chamber tube 1. This takes place, for example, at a pressure of only two bar, which is provided by means of the pump 15 in the sump or pre-clarification basin 13.

A central control system is provided because a continuous filling of the chambers 2 to 4 or a continuous transportation takes place by means of the three-chamber tube feeder 1, in that the signals of timing circuits and/or integrators are operated by contact manometers as well as by means of limit switches of the blocking members 8 and 11 provided as high pressure double disc valves.

While the chamber 2 transports the mining water or warm water via the high pressure mining water conduit into the aboveground region 3. The chamber 3 is filled with mining water or warm water. As compared to this the chamber 4 is filled with fresh or cold water and is in a condition ready for being filled with mining or warm water.

The fresh or cold water fed from the chambers 2, 3 and 4 of the three chamber tube feeder into the low pressure region LP arrives via the low pressure fresh water conduit 17 into a fresh water basin 18, from where it is supplied by means of a pump 19 to the user by means of the conduit 20.

A three-chamber tube feeder 1, according to the example of an embodiment if FIG. 1, has the following manner of operation:

On opening of the blocking member 8 of the chamber 3, for example provided as high pressure double disc valve, the inflow of fresh or cold water from the high pressure fresh water conduit 6 causes that the mining water, present in the chamber 2, on opening of the nozzle non-return valve 10 is pressed into the high pressure mining water conduit 16 and is transported through this to the aboveground region 5.

However, simultaneously the blockng member 11 of the chamber 3, which for example is provided as a high pressure double disc valve, is opened, whereby on opening of the blocking member 9 provided as nozzle non-return valve mining water or warm water arrives into the chamber 8 by means of the pump 15 and the low pressure mining water conduit 14.

This mining or warm water thereby displaces the fresh water or cold water present in the chamber 3 through the blocking member 11, which is open, into the low pressure fresh water conduit 17, from where it then moves into the fresh water basin 18.

Because the chamber 4 filled with fresh or cold water, after the pressure compensation, is ready for being filled with mining or warm water, all blocking members 8 to 11, namely both the two remote controlled high pressure double discs valves 8 and 11 as well as the automatically operating nozzle non-return valves 9 and 10, are closed.

It is to be mentioned here that the construction of the nozzle non-return valves constituting the blocking members 9 and 10 can be seen in FIG. 2. Thereby the nozzle non-return valves forming the blocking members 9 are fitted in such a manner between the chambers 2, 3 and 4 of the three chamber tube feeder 1 and the low pressure mining water conduit 14 that they can close automatically in the direction against the low pressure mining water conduit.

As compared to this the nozzle non-return valves forming the blocking members 10 between the chambers 2, 3 and 4 of the three chamber tube feeder 1 as well as the high pressure mining water conduit 16 have a constructional position in which they automatically move into the closed position against the chamber 2, 3 or 4.

Because the nozzle non-return valves of the blocking member 9 and 10 each operate automatically, that is without direct remote control, they are in both possible operational positions—open position and close position—only dependent on the respective operational condition of each of the individual chambers 2, 3 and 4 of the three chamber tube feeder 1.

It has been shown that by means of the allocation of the nozzle non-return valves on the one hand to the low pressure filling side allocated to the mining water or warm water as well as to the high pressure discharge side of each chamber 2, 3 and 4 allocated to the mining water or warm water pressure, surges or water hammer caused by operational conditions can be prevented extensively in the overall system.

FIG. 2 of the drawings an example of an embodiment of a nozzle non-return valve 21 is shown. The housing 22 thereby has an inlet connection 23 and an outlet connection 24. Co-axially to the housing 22 nozzle body 25 is provided narrowing in the direction from the inlet connection 23 towards the outlet connection 24.

A valve plate 26 in turn is held co-axially to the nozzle body 25 and stands in direction counter to a seat ring 28 arranged against the inlet connection 23 under the action of a closing spring 27. Only if the medium pressure acting on the inlet connection 23 is greater than the return force acting on the valve plate 26 biased by the spring 27, the nozzle non-return valve 21 is opened and allows the medium under pressure to pass through. (This is shown in the upper half of the drawing).

If the pressure and flow velocity of the medium drops below the adjusted spring force, then the valve plate 26 immediately moves against the seat ring and thereby closes the nozzle non-return vale 21 against a flow back of the medium to the inlet connection 23. (This is shown in the lower half of the drawing).

Having now in detail described and ascertained our invention and the way in which it is to be performed, we declare that what we claim is:

1. An arrangement for the changeover of mine or warm water and fresh or cold water in underground mining by means of a three chamber tube feeder with constant filling and discharge direction, which feeder is arranged between a high pressure liquid cycle, which forms on the one hand, an aboveground feeding-in of the fresh or cold water and, on the other hand, a transportation of the mining or warm water, and an underground low pressure liquid cycle, which three chamber tube feeder ensures a direct and continuous changeover, and which feeder is provided with blocking members at the end of the chambers, wherein automatic no-return valves (9, 10) are provided as the blocking members exclusively at a low pressure filling side (14), allocated to the mining or warm water, and at a high pressure discharge side (16), allocated to the mining or warm water, of each chamber (2, 3, 4) of the three chamber tube feeder, a separate externally controlled high pressure side valve (8, 11) being provided as the blocking member at a high pressure fresh or cold water inlet side (6), and at a low pressure fresh or cold water discharge side (17), of each chamber (2, 3, 4) of the feeder (1).

2. An arrangement as claimed in claim 1, wherein the non-return valves forming the blocking members (9 and 10) are automatically operating nozzle non-return valves.

* * * * *